US005857470A

United States Patent [19]

Schmidt et al.

[11] Patent Number: 5,857,470

[45] Date of Patent: Jan. 12, 1999

[54] DEVICE FOR THE STYLING AND DRYING OF HAIR

[75] Inventors: Heike Schmidt, Oberursel; Georg Möthrath, Gelnhausen; Peter Herber, Bad Bergzabern, all of Germany

[73] Assignee: Braum Aktiengesellschaft, Kronberg, Germany

[21] Appl. No.: 765,509

[22] PCT Filed: Mar. 6, 1996

[86] PCT No.: PCT/EP96/00938

§ 371 Date: Dec. 18, 1996

§ 102(e) Date: Dec. 18, 1996

[87] PCT Pub. No.: WO96/33635

PCT Pub. Date: Oct. 31, 1996

[30] Foreign Application Priority Data

Apr. 26, 1995 [DE] Germany ..... 195 15 264.6

[51] Int. Cl.[6] ..... A45D 2/36

[52] U.S. Cl. ..... 132/211; 132/227; 132/252

[58] Field of Search ..... 132/211, 220, 132/227, 251, 252; 126/263.05, 263.01

[56] References Cited

U.S. PATENT DOCUMENTS

| | | | |
|---|---|---|---|
| 2,018,367 | 10/1935 | Lackenbach | 126/263.05 |
| 2,076,521 | 4/1937 | List . | |
| 2,126,734 | 8/1938 | Chancey | 132/220 |
| 2,152,672 | 4/1939 | Solomon | 132/220 |
| 2,172,033 | 9/1939 | Pisciotta | 132/220 |
| 2,533,958 | 12/1950 | Root et al. | 132/220 |
| 3,656,490 | 4/1972 | Grossman . | |
| 3,682,181 | 8/1972 | Garrett | 132/220 |
| 4,041,961 | 8/1977 | Shaler et al. . | |
| 4,190,065 | 2/1980 | Kulpa . | |
| 4,955,360 | 9/1990 | Ogawa et al. | 126/263 |
| 5,299,367 | 4/1994 | Johnson et al. | 34/95 |
| 5,711,324 | 1/1998 | Johnson et al. | 132/252 |

FOREIGN PATENT DOCUMENTS

| | | | |
|---|---|---|---|
| 0 140 380 | 5/1985 | European Pat. Off. | B01D 53/26 |
| 989551 | 9/1951 | France | 132/220 |
| 1 109 318 | 6/1961 | Germany . | |
| 379464 | 7/1940 | Italy | 132/220 |
| 554151 | 6/1943 | United Kingdom | 132/220 |

*Primary Examiner*—Todd E. Manahan
*Attorney, Agent, or Firm*—Edward S. Podszus

[57] ABSTRACT

The invention is directed to a device for the styling and/or drying of hair, including an exothermic material that is enclosed by a gas-permeable film. Applied to the outer surface of the film at least in certain areas thereof is a water-absorbent fabric, which comes into direct contact with the hair when the device is used. The device finds application preferably as a self-contained, regenerable hair roller.

46 Claims, 2 Drawing Sheets

Fig. 1
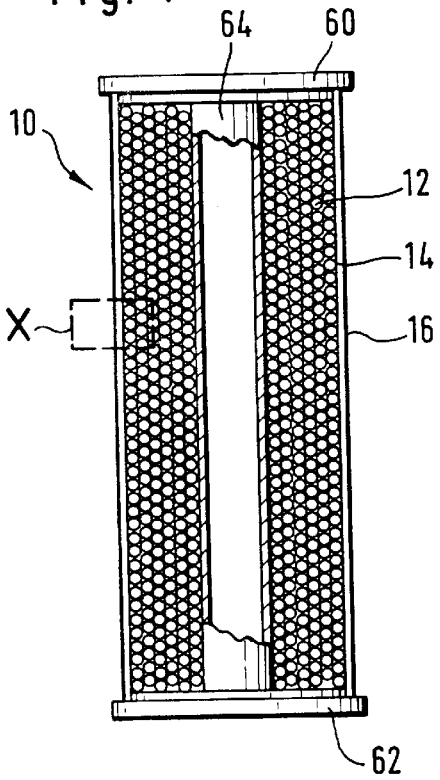
Fig. 3a
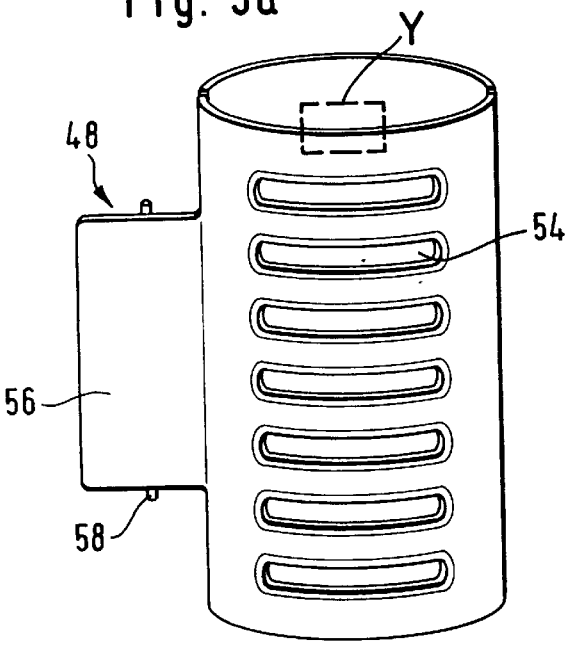
Fig. 3b [„Y"]
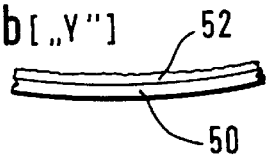
Fig. 4
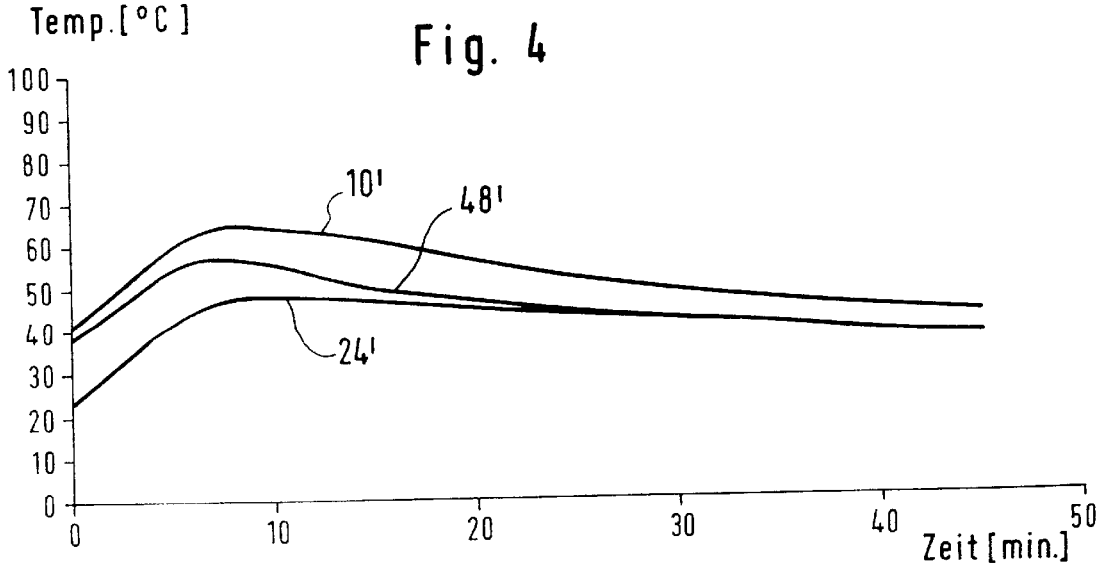

Fig. 2 [„X"]
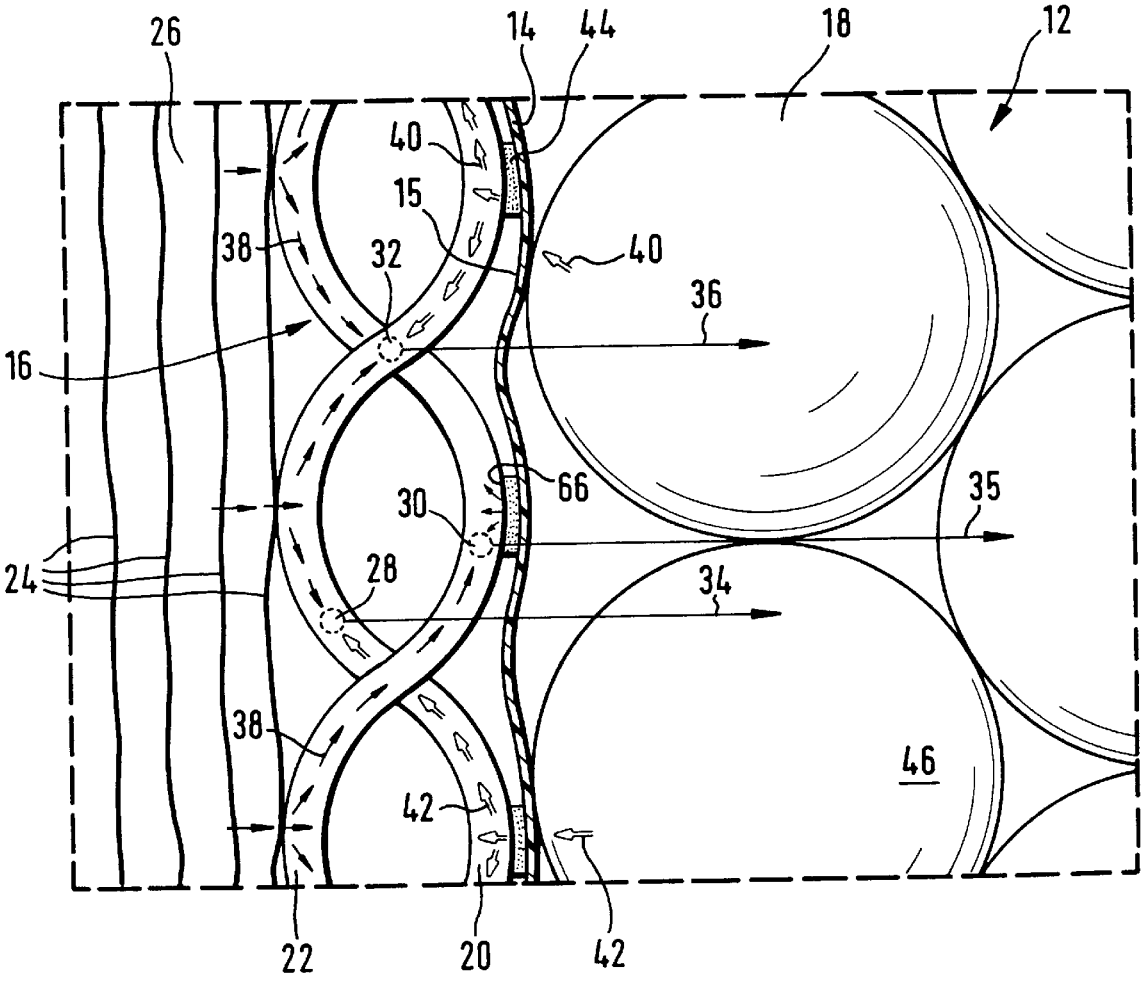

DEVICE FOR THE STYLING AND DRYING OF HAIR

This is a continuation of International Application No. PCT/EP96/00938, pending, with an international filing date of Mar. 6, 1996.

This invention relates to a device for the styling and/or drying of in particular wet hair, such as a hair roller, a curling wand or the like, including an exothermic material that is enclosed by a gas-permeable film.

Such a drying element and a method for its use are already known from EP 0 140 380 A2. This printed specification describes, inter alia, a hair roller whose gas-permeable enclosure performs the function of a roller body and holds the desiccant inside. The term gas-permeable enclosure as used in this application is understood to mean a gas-permeable film, a gas-permeable membrane or the like. As desiccant it is proposed to use in particular synthetic zeolites, which are characterized by a sufficiently high thermal and cyclic stability. After use, the drying elements are regenerated in the air by the action of heat and are thus ready to be used again. When water vapor is applied to the hair rollers and to the zeolite enclosed therein, because of the physical bonding of the water vapor the zeolite material emits adsorption heat which is intended to heat and dry the hair.

As practical tests have shown, the known hair roller is not particularly well suited for the drying and/or styling of wet hair. On the one hand, it results in an undesirably long drying period of an hour and more, and on the other hand the amount of heat emitted by the zeolite is not enough to heat the hair to a sufficiently high temperature.

The underlying object of the present invention is, by contrast, to further develop the device embodying the features initially referred to so that the user's hair is dried and/or styled within an acceptable period of time. In particular it is aimed to heat the hair to a temperature of approximately 35° C. or higher and to dry it to a residual moisture content of less than 6 to 10% within a period of less than approximately 45 minutes.

SUMMARY OF THE INVENTION

In a device incorporating the features initially referred to this object is accomplished essentially in that a water-absorbent fabric or the like, for examples a synthetic fiber fabric, is applied to the outer surface of the film at least in certain areas thereof which fabric comes into direct contact with the hair when the device is used. Depending on the type of membrane, the type of carrier fabric and the degree of regeneration of the exothermic material, it is thereby possible to generate temperatures of approximately 50° to 90° C. in the exothermic material, and of approximately 35° to 50° C. in the hair, with the hair being dried within a period of between 30 and 45 minutes, approximately. The mode of operation of the device is as follows:

The wet hair, which is to be dried and/or styled, is surrounded by an atmosphere of water vapor. A high vapor pressure differential develops between the hair and the exothermic material on account of the high adsorption power of the exothermic material inside the device. The water vapor flows in between the fibers of the water-absorbent fabric and via the pores of the gas-permeable film to the exothermic material. The water vapor is bonded physically in the exothermic material, adsorption heat being emitted in the process. The device thus begins with the emission of heat automatically when wet hair is wound onto the hair roller, which in daily use is extremely advantageous.

The more water molecules bonded in this process, the greater the amount of heat. Capillary water, that is, water in the liquid phase clinging, for example, to the surface of the wet hair, does not pass through the film because the film's permeability preferably applies only to water in the vapor phase. The heat generated in the exothermic material passes via the film into the fibers of the fabric mainly by thermal conduction. On the other hand, on their side facing the hair, these fibers take up capillary water from the surface of the strands of hair by diffusion, causing the fabric to swell. The taken up water travels through the fibers and reaches those areas heated by the heat emitted by the exothermic material. This results in the formation of vaporization points in the fabric. Driven by the existing vapor pressure differential, the water vapor finally passes through the film to the exothermic material where it is bonded and leads to a further emission of heat.

This device enables a gentle drying and/or styling of wet hair without an external source of heat as is the case, for example, with electrically heated appliances such as hair dryers or the like. Further advantages for the user are the agreeable sensation of temperature on his or her head, freedom of movement because cordless use is possible, noiseless operation, and the ability of the device to regenerate after use.

Advantageously, the fabric is constructed as a carrier fabric, and the film is laminated on the carrier fabric by means of an adhesive. It is an advantage for approximately 25% to 50%, preferably 35%, of the film surface to be covered with adhesive. In those areas of the film covered with the adhesive there results a particularly intimate connection of the fabric with the film, and a particularly good transfer of the heat emitted by the exothermic material to the fabric.

Advantageously, vaporization of the water taken up from the wet hair takes place in the fabric. A controlled water vapor atmosphere is thus built up directly adjacent to the gas-permeable film, ensuring a sufficiently high emission of heat from the exothermic material on the one hand, while on the other hand leading to faster drying of the wet hair through a continuous carrying off of the heat generated by the physical bonding in the exothermic material.

Advantageously, the fabric is thermally stable above a temperature of 180° C., approximately, and/or the fabric has a thickness of less than 0.3 to 0.7 mm, preferably 0.5 mm, and/or the water absorbency of the fabric lies in a range from 1 to 15 percent by weight, preferably 5 percent by weight. Practical tests have revealed that in particular aromatic polyamide and aramide, for example Nomex or Keflar (registered trademarks), find application as fabric material, a thickness of 0.35 mm to 0,5 mm, a water absorbency of 5 percent by weight, and a thermal stability at a temperature of over 200° C. having proven to be particularly advantageous.

According to a further advantageous aspect of the present invention, the film is configured as a water-vapor-permeable, microporous membrane.

The film is advantageously made of polytetrafluoroethylene (PTFE). Such films are available from the company Gore, for example.

According to another advantageous aspect of the present invention, the film is impermeable to water and/or thermally stable at a temperature of over 180° C., approximately, and/or has a thickness of less than 0.1 mm, preferably 0.05 mm, and/or possesses a porosity of greater than 70%, approximately, preferably 90%. The fact that the film is impermeable to water rules out any contact of the exothermic material with capillary water, that is, non-vaporous water, whereby a longer useful life of the exothermic material, for example the zeolite, is ensured. The high thermal stability of the film and of the fabric as well proves to be an advantage for the regeneration of the exothermic material by externally supplied heat, because the higher the regeneration temperature the shorter the regeneration period and the greater the degree of regeneration. The small film thickness of less than 0.1 mm combines with the equally small fabric thickness of 0.5 mm, approximately, to ensure that the hair wound on the device is only at a very small relative distance to the exothermic material, thus ensuring good thermal contact. The film's high porosity of greater than 70% or of 90% ensures that the water vapor flowing from the wet hair in the direction of the exothermic material as the result of the vapor pressure differential does not encounter any substantial obstruction in its path by the membrane. The water vapor molecules are allowed to pass through the membrane practically unhindered and be bonded physically to the exothermic material.

According to a further feature of the present invention, the exothermic material is a zeolite, in particular a magnesium aluminum silicate. This zeolite material is available under the trade name Baylith (registered trademark) TEG 273 from the company Bayer, for example.

It has proven to be extremely advantageous for the exothermic material to be in the form of beads having an average diameter of 2 to 4 mm, preferably 3 mm, approximately, and/or an average pore diameter of 0.3 to 0.5 nanometers, approximately. Thus it is assured that the packing density of the exothermic material in the device is not too high, and that accordingly the water vapor flowing from the outside into the exothermic material reaches not only the outer layers of the exothermic material next to the gas-permeable film but also the inner layers of the exothermic material, causing the emission of adsorption heat there too.

According to a further advantageous feature of the present invention, a metal core or metal tube or the like, in particular an aluminum core or aluminum tube, is arranged in the interior of the device as a means to ensure the supply of heat from an external heat source to the exothermic material for the purpose of regenerating the exothermic material. The device can thus be placed on a heating mandrel or the like for the purpose of regenerating the exothermic material, that is, desorbing the physically bonded water, and be used again to style and/or dry the user's hair.

Advantageously, the device is constructed as a hair roller having a central metal core or metal tube that is surrounded by the zeolite, the water-vapor-permeable film and the fabric in the form of a shell.

With the hair roller according to the present invention in which the exothermic material is regenerated to in particular 75% to 90%, approximately, it is possible during use to generate temperatures of approximately 50° C. to 80° C. or 90° C. in the hair roller, and temperatures of approximately 35° C. to 50° C. in the hair for a period of between 30 minutes and 45 minutes, approximately.

According to a further feature of the invention, provision is made for a hair holding clip, which may equally contain zeolite and embraces the hair roller and the hair placed on it essentially in the manner of a clasp, with the hair holding clip being provided with a water-absorbent fabric material on the wall section on the side close to the hair roller and the hair. Advantageously, this fabric includes the same or similar features as the fabric applied to the film. On the one hand, this hair holding clip establishes an intimate contact between the hair and the hair roller, and on the other hand the water-absorbent fabric applied to the inner surface of the hair holding clip acts as an additional means of carrying water away from the wet hair.

In this arrangement it has proven particularly advantageous for the wall sections of the hair holding clip to include several apertures through which the water vapor taken up in the fabric can be released to the outside.

It is also possible to fill the hair holding clip with zeolite, whereby the drying process is accelerated further still.

Further features, advantages and application possibilities of the present invention will become apparent from the subsequent description of embodiments illustrated in more detail in the accompanying drawings. It will be understood that any single feature and any combination of single features described and/or represented by illustration form the subject-matter of the present invention, irrespective of their summary in the claims and their back reference.

BRIEF DESCRIPTION OF THE DRAWINGS

FIG. 1 is a schematic side view of the hair roller constructed in accordance with the present invention;

FIG. 2 is a schematic view of detail "X" of FIG. 1 on an enlarged scale;

FIG. 3 at FIG 3*a* is a view of a hair holding clip adapted to be clampingly attached to the hair roller of FIG. 1;

FIG. 3 at FIG 3*b* is a view of detail "Y" of FIG. 3*a;* and

FIG. 4 is a graphical representation of the temperatures in the hair roller, in the hair holding clip and in the user's hair, plotted against time.

DETAILED DESCRIPTION OF THE DRAWINGS

The hair roller 10 shown in FIG. 1 has a central metal tube 64 surrounded by an exothermic material 12 in the form of a ring. The exothermic material 12 is in particular a zeolite 18 in the form of beads 46 (FIG. 2). The exothermic material 12 is surrounded by a gas-permeable film 14 having applied to its outer surface 15 a water-absorbent fabric material 16. Advantageously, the fabric 16 is constructed as a carrier fabric, and the film 14 is laminated on the carrier fabric by means of an adhesive 44. The spherical zeolite material 18 is surrounded by the film 14 and the fabric 16 in the form of a cylindrical sheath. The head and foot ends of the cylindrical sheath are formed by the bottoms 60, 62, with at least one bottom having a central opening enabling, for example, a heating mandrel to be inserted into the metal tube 64 in order to regenerate the zeolite 18.

As becomes apparent from the enlargement of detail "X" in FIG. 2, the fabric 16 is formed by fiber bundles 20, 22. On the one hand, these fiber bundles 20, 22 are in close contact with the hair 24, which is moist with capillary water 26 and wound on the hair roller 10. On the other hand, the fibers 20, 22 are in intimate connection with the gas-permeable film 14 via individual sections 66 of the adhesive 44.

The water taken up by the water-absorbent fabric 16 travels through the fibers 20, 22 in the direction indicated by the arrows 38. On the other hand, heat is emitted by the zeolite 18 as the result of the physical bonding of the water vapor in the zeolite 18, propagating in the direction of the arrows 40, 42. The water taken up by the fibers 20, 22 strikes those areas that are heated by the heat emitted by the zeolite 18, which results in the formation of vaporization points 28, 30, 32. Driven by the vapor pressure differential, the water vapor originating from these vaporization points 28, 30, 32 passes through the film 14 to the zeolite 18, which is indicated by the arrows 34, 35 and 36. This water vapor is bonded in turn in the zeolite 18, whereby heat is again emitted by the zeolite. It is noted in this connection that FIG. 2 is a schematic and simplified model of the complex operations taking place.

The hair holding clip 48 of FIG. 3 includes two wall sections 50 conforming in curvature to the diameter of the hair roller 10 and covered on the inside at least partly with a fabric material 52. On the side of the wall sections 50, grip elements 56 are provided, which are joined together by means of a spring hinge 58. In addition, the wall sections 50 may be provided with several apertures 54 or include a cavity equally filled with zeolite 18.

The fabric material 16 is selected according to the following factors and/or requirements: It should be thermally stable at a temperature above approximately 180° C. or at 200° C., and the fabric 16 should have sufficient water absorbency or swelling capacity, have a small thickness or low diffusion resistance, and exhibit good wetting properties.

As practical tests have shown, a good compromise to meet these requirements is to use a fabric 16 that is made of aromatic polyamide or aramide. These fabric materials 16 are known under the registered trademarks Nomex and Keflar; the fabric 16 should have a thickness of approximately 0.35 to 0.5 mm, a water absorbency of approximately 5 percent by weight, and a thermal stability at 180° C. or over.

A suitable gas-permeable film 14 is a PTFE film with a thickness of approximately 0.05 mm, an average pore size of 5 micrometers, and a porosity of up to 90%. Such films 14 are commercially available under the registered trademark Goretex. Advantageously, the gas-permeable film 14 and the fabric 16 are joined together by a thermally stable lamination.

As zeolite 18 it is an advantage to use magnesium aluminum silicate in the form of beads, with an average bead diameter of 2.5 to 3 mm, and a pore size of the order of 0.4 nanometers, approximately. This zeolite material is available under the registered trademark Baylith TEG 273 from the company Bayer, for example.

FIG. 4 is a graph showing temperatures plotted against time during the use of a hair roller 10 according to the embodiment. The curve identified by reference numeral 24' reflects the temperatures in the hair 24, the curve identified by reference numeral 48' the temperatures at the hair holding clip 48, and the curve identified by reference numeral 10' the temperatures in the interior of the hair roller 10. As appears clearly, the temperature in the hair 24 lies above 40° C. for a period of approximately 30 to 45 minutes. After 45 minutes it is possible with the described hair roller 10 to achieve good drying and styling results on the user's wet hair, with the residual moisture content then amounting to just 6 to 7%, approximately.

We claim:

1. A hair drying apparatus for use in the treatment of drying and styling damp hair, said apparatus comprising:

a heat producing material comprising a zeolite adapted to generate heat by an exothermic reaction when activated by water, a liquid water impermeable microporous film surrounding said heat producing material, said film being water vapor permeable, and a sheet of liquid absorbent fabric having first and second surfaces, said first surface of said absorbent fabric positioned in at least partially overlying relation to said microporous film, said second surface of the absorbent fabric forming an outermost surface from among the heat producing material, the film and the absorbent fabric, whereby when damp hair is contacted about the absorbent fabric second surface, the fabric sheet forms an evaporation situs for liquid water wicked by the fabric from the hair, and the heat generated dries the hair.

2. A hair drying apparatus as claimed in claim 1, wherein said microporous film has an average pore size of about 5 micrometers.

3. A hair drying apparatus as claimed in claim 1, wherein said absorbent fabric sheet first surface is co-extensive with said microporous film.

4. A hair drying apparatus as claimed in claim 1, wherein said absorbent fabric sheet supportingly carries said microporous film.

5. A hair drying apparatus as claimed in claim 1, wherein said absorbent fabric sheet is heat stable to a temperature above about 180° C., thereby promoting, after use, regeneration of said heat producing material in the presence of an externally supplied energy source.

6. A hair drying apparatus as claimed in claim 1, wherein said absorbent fabric sheet has a thickness between less than about 0.3 mm and about 0.7 mm, thereby promoting thermal transfer between the hair and the heat producing material.

7. A hair drying apparatus as claimed in claim 6, wherein said absorbent fabric sheet has a thickness about 0.5 mm.

8. A hair drying apparatus as claimed in claim 1, wherein said fabric sheet has a water absorbency of between about 1 percent by weight to about 15 percent by weight.

9. A hair drying apparatus as claimed in claim 8, wherein said fabric sheet has a water absorbency about 5 percent by weight.

10. A hair drying apparatus as claimed in claim 1, wherein said fabric sheet is selected from the group consisting of aromatic polyamide and aramide.

11. A hair drying apparatus as claimed in claim 1, wherein said microporous film is laminated to said absorbent fabric with an adhesive.

12. A hair drying apparatus as claimed in claim 11, wherein said adhesive bonds said microporous film at a plurality of locations, an area of said plurality of adhesive locations collectively being between about 25% to about 50% of a surface area of said microporous film, whereby said adhesive locations promote heat transfer between said absorbent fabric and said microporous film.

13. A hair drying apparatus as claimed in claim 12, wherein said area of adhesive locations is about 35% of said microporous film surface area.

14. A hair drying apparatus as claimed in claim 1, wherein said microporous film further comprises polytetraflouroethylene (PTFE).

15. A hair drying apparatus as claimed in claim 1, wherein said microporous film is heat stable to a temperature above about 180° C., thereby promoting, after use, regeneration of said heat producing material in the presence of an externally supplied energy source.

16. A hair drying apparatus as claimed in claim 1, wherein said microporous film has a thickness of not greater than about 0.1 mm.

17. A hair drying apparatus as claimed in claim 16, wherein said microporous film thickness is about 0.05 mm.

18. A hair drying apparatus as claimed in claim 1, wherein said microporous film has a porosity of greater than about 70%.

19. A hair drying apparatus as claimed in claim 18, wherein said microporous film porosity is about 90%.

20. A hair drying apparatus as claimed in claim 1, wherein said zeolite further comprises magnesium aluminum silicate.

21. A hair drying apparatus as claimed in claim 1, wherein said heat producing material is shaped as a plurality of beads having an average diameter of between about 2 mm to about 4 mm, thereby defining vapor passageways between beads for admission of water vapor to a surface of said beads in an interior of said heat producing material.

22. A hair drying apparatus as claimed in claim 21, wherein said bead average diameter is about 3 mm.

23. A hair drying apparatus as claimed in claim 1, wherein said heat producing material has an average pore diameter of between about 0.3 nanometers to about 0.5 nanometers.

24. A hair roller comprising the hair drying apparatus as claimed in claim 1, further comprising a metal core surrounded radially by said heat producing material, said microporous film and said absorbent fabric.

25. A hair drying apparatus as claimed in claim 24, wherein said heat producing material produces a temperature in said hair drying apparatus of between about 50° C. and about 80° C. for a time period of at least about 30 min.

26. A hair drying apparatus as claimed in claim 1, further comprising a clamp retaining hair in contact with said second surface of said absorbent fabric sheet, whereby said clamp further comprises a wall portion facing said second surface of said absorbent fabric sheet and a second liquid absorbent fabric disposed on said wall portion.

27. A hair drying apparatus as claimed in claim 26, wherein said clamp wall portion further defines a plurality of apertures, whereby evolved water vapor exits through said apertures to an outside atmosphere.

28. A hair drying apparatus as claimed in claim 27, wherein said clamp wall portion further comprises a zeolite disposed therein.

29. A hair drying apparatus for use in the treatment of drying and styling damp hair, said apparatus comprising:

a heat producing material comprising a chemical adapted to generate heat by an exothermic reaction when activated by water, a liquid water impermeable microporous film surrounding said heat producing material, said film being water vapor permeable, a sheet of liquid absorbent fabric having first and second surfaces, said first surface of said absorbent fabric positioned in at least partially overlying relation to said microporous film, said second surface of the absorbent fabric forming an outermost surface from among the heat producing material, the film and the absorbent fabric, and a core disposed on an interior of said heat producing material, whereby when damp hair is contacted about the absorbent fabric second surface, the fabric sheet forms an evaporation situs for liquid water wicked by the fabric from the hair, and the heat generated dries the hair, and whereby an external energy source applied to said core assists regenerating said heat producing material.

30. A hair drying apparatus as claimed in claim 29, wherein said core further comprises an aluminum tube.

31. A hair drying apparatus as claimed in claim 29, wherein said core further comprises metal.

32. A regeneratable hair drying apparatus for use in styling damp hair during drying, said apparatus comprising:

a heat producing material comprising a zeolite to generate heat by an exothermic reaction when activated by water, a microporous film surrounding said heat producing material, said film having a porosity of at least about 70% and being liquid water impermeable and water vapor permeable, said film having a thickness of less than about 0.1 mm and being heat stable at a temperature at least about 180° C., and a sheet of liquid absorbent fabric having first and second surfaces, said first surface of said absorbent fabric positioned in overlying relation to said microporous film, said second surface forming an outermost surface of said regeneratable hair dryer apparatus, said fabric sheet having a thickness of between about 0.3 mm to about 0.7 mm, a water absorbency of at least about 5 percent by weight and being heat stable at a temperature at least about 180° C., whereby when damp hair is contacted about the absorbent fabric second surface, the fabric sheet forms an evaporation situs for liquid water wicked by the fabric from the hair, and the heat generated dries the hair, and, after use, thermal stability of said microporous film and said absorbent fabric sheet promotes regeneration of said heat producing material in the presence of an externally supplied energy source.

33. A regeneratable hair drying apparatus as claimed in claim 32, wherein said heat producing material is formed as beads having an average diameter of about 3 mm, thereby defining vapor passageways between beads for admission of water vapor to a surface of said beads in an interior of said heat producing material, and said microporous film has an average pore size of about 5 micrometers.

34. A regeneratable hair drying apparatus as claimed in claim 33, wherein said zeolite beads have an average pore size of about 0.4 nanometers.

35. A regeneratable hair drying apparatus as claimed in claim 32, further comprising an adhesive laminating said microporous film to said absorbent sheet at a plurality of lamination locations collectively comprising at least about 25% of a surface area of said microporous film, thereby promoting heat transfer between said absorbent fabric and said microporous film.

36. A regeneratable hair drying apparatus as claimed in claim 32, further comprising a metal core disposed on an interior of said heat producing material, whereby an external energy source applied to said metal core assists regenerating said heat producing material.

37. A regeneratable hair drying apparatus as claimed in claim 32, wherein said zeolite further comprises magnesium aluminum silicate.

38. A method of drying and styling damp hair, comprising the steps of providing a regeneratable hair drying apparatus comprising a heat producing material comprising a zeolite generating heat by an exothermic reaction when activated by water, a microporous film surrounding said heat producing material, said film being liquid water impermeable and water vapor permeable, and a sheet of liquid absorbent fabric having first and second surfaces, said first surface of said absorbent fabric overlying said microporous film, contacting the absorbent fabric second surface with damp hair, wicking water from the damp hair into the fabric, permeating water vapor through said film while not permeating liquid water therethrough to activate said heat producing material to generate heat, and transferring heat from said heat producing material to generate a temperature in the hair of at least about 35° C. for a duration of about 45 minutes, whereby the damp hair is styled about the absorbent fabric second surface and dried to a residual moisture content of less than 10%.

39. The method of claim 38, wherein the step of transferring further comprises generating the temperature in the hair of at least about 40° C. for a duration of about 30 minutes.

40. The method of claim 38, wherein the step of providing further comprises the microporous film and the absorbent fabric sheet each being thermally stable at a temperature of at least about 180° C., and further comprising the step of regenerating to at least 75% said heat producing material with an externally supplied energy source.

41. The method of claim 38, wherein the step of providing further comprises the step of laminating said absorbent fabric sheet to said microporous film, thereby promoting heat transfer between said absorbent fabric sheet and said microporous film.

42. The method of claim 38, wherein the step of providing further comprises said microporous film having a thickness of less than about 0.1 mm and a porosity of at least about 70%, and said fabric sheet having a thickness of less than about 1 mm and a water absorbency of at least about 5 percent by weight.

43. The method of claim 38, wherein the step of providing further comprises said zeolite being shaped as beads having an average diameter of about 3 mm and said microporous film having an average pore size of about 5 micrometers.

44. The method of claim 38, wherein the step of providing further comprises said zeolite comprising magnesium aluminum silicate.

45. A hair drying apparatus for use in the treatment of drying and styling damp hair, said apparatus comprising:

a heat producing material comprising a chemical adapted to generate heat by an exothermic reaction when activated by water, a liquid water impermeable microporous film surrounding said heat producing material, said film being water vapor permeable, and a sheet of liquid absorbent fabric having first and second surfaces, said first surface of said absorbent fabric positioned in at least partially overlying relation to said microporous film, said second surface of the absorbent fabric forming an outermost surface from among the heat producing material, the film and the absorbent fabric, whereby when damp hair is contacted about the absorbent fabric second surface, the fabric sheet forms an evaporation situs for liquid water wicked by the fabric from the hair, and the heat generated dries the hair, and wherein said absorbent fabric sheet is heat stable to a temperature above about 180° C., thereby promoting, after use, regeneration of said heat producing material in the presence of an externally supplied energy source.

46. A hair drying apparatus for use in the treatment of drying and styling damp hair, said apparatus comprising:

a heat producing material comprising a chemical adapted to generate heat by an exothermic reaction when activated by water, a liquid water impermeable microporous film surrounding said heat producing material, said film being water vapor permeable, and a sheet of liquid absorbent fabric having first and second surfaces, said first surface of said absorbent fabric positioned in at least partially overlying relation to said microporous film, said second surface of the absorbent fabric forming an outermost surface from among the heat producing material, the film and the absorbent fabric.

whereby when damp hair is contacted about the absorbent fabric second surface, the fabric sheet forms an evaporation situs for liquid water wicked by the fabric from the hair, and the heat generated dries the hair, and wherein said microporous film is heat stable to a temperature above about 180° C., thereby promoting, after use, regeneration of said heat producing material in the presence of an externally supplied energy source.

* * * * *

UNITED STATES PATENT AND TRADEMARK OFFICE

CERTIFICATE OF CORRECTION

PATENT NO. : 5,857,470
DATED : January 12, 1999
INVENTOR(S) : Schmidt, et. al.

It is certified that error appears in the above-identified patent and that said Letters Patent is hereby corrected as shown below:

Title page, item [22] should read --Filed: Dec. 18, 1996--

Title page, before item [30] Foreign Application Priority Data: insert--

Related U.S. Application Data:
Continuation of PCT/EP 96/00938 Filed Mar. 6, 1996--

Signed and Sealed this

Eleventh Day of April, 2000

*Attest:*

*Attesting Officer*

Q. TODD DICKINSON

*Director of Patents and Trademarks*